US006178680B1

(12) United States Patent
Sloot

(10) Patent No.: US 6,178,680 B1
(45) Date of Patent: Jan. 30, 2001

(54) APPLIQUE FOR APPAREL AND METHOD FOR MAKING THE APPLIQUE

(75) Inventor: Alexander Sloot, Sugarloaf, PA (US)

(73) Assignee: Printmark Industries, Inc., Hazleton, PA (US)

( * ) Notice: Under 35 U.S.C. 154(b), the term of this patent shall be extended for 0 days.

(21) Appl. No.: 09/109,291

(22) Filed: Jun. 30, 1998

(51) Int. Cl.[7] ..... G09F 3/12
(52) U.S. Cl. ..... 40/668; 40/661.04; 40/661.11
(58) Field of Search ..... 40/668, 315, 329, 40/661.11, 661.04, 636, 622, 586, 124.01, 124.11, 661.09, 630, 301; 36/136; 24/108, 113 R, 113 MP; 2/422

(56) References Cited

U.S. PATENT DOCUMENTS 508,149 * 11/1893 Schumm ..... 40/124.01 X
791,912 * 6/1905 Jackson ..... 40/124.01 X
1,805,937 * 5/1931 Berge ..... 24/113 MP X
2,146,047 * 2/1939 Bangs ..... 40/622
2,296,373 * 9/1942 Wax et al. ..... 40/329 X
3,408,105 * 10/1968 Portell ..... 24/113 R X
3,449,802 * 6/1969 Mackey ..... 24/113 R
5,802,754 * 9/1998 Watanabe ..... 40/630

FOREIGN PATENT DOCUMENTS

0047697 * 3/1982 (EP) ..... 40/301

* cited by examiner

*Primary Examiner*—Joanne Silbermann
(74) *Attorney, Agent, or Firm*—St. Onge Steward Johnston & Reens LLC

(57) ABSTRACT

An applique and method for making it are described wherein inner and outer vinyl sheets are welded together to form a decorative applique and wherein a pair of fastener are employed each having a flat segment that is embedded between the inner and outer vinyl sheets and has a stem that extends through the inner sheet, its outer located adhesive layer and overlying release liner. Caps are used to enable the applique to be affixed to a carrier card for shipment to an end user, who can then remove the caps and use the fasteners to affix the applique to apparel using the adhesive and re-use the fasteners. The combination of the adhesive and the fasteners enable a firm and sustaining attachment of the applique to surfaces having a low affinity to the adhesive employed on the inner layer.

8 Claims, 4 Drawing Sheets

APPLIQUE FOR APPAREL AND METHOD FOR MAKING THE APPLIQUE

FIELD OF THE INVENTION

This invention generally relates to an applique attachable to apparel such as T-shirts, sweaters, hats, shorts, accessories water proof materials and the like and a technique for making such applique. More specifically this invention relates to an appliques which can be affixed to a promotion card and subsequently affixed to an apparel by the end user.

BACKGROUND OF THE INVENTION

Appliques for attachment to apparel, such as hats, T-shirts and other clothing, are well known in the art. These can be affixed by way of heat seals, adhesives or R.F. welded directly to apparel or sewn on. The applique can be of many types and have a three dimensional characteristic by including a puffy foam laminated between opposing vinyl layers, one of which typically bears a decorative design.

Fasteners for attaching materials to penetrable surfaces are known in the art. For example, one such fastener involves a male element having a flat segment and an elongate pin extending therefrom. A female element having a central opening with spring loaded locks enables one to capture the pin extending through the material and thus attach it to the surface. Another known fastener is made with a flat metal piece that can be stamped out from a parent sheet and is provided with laterally located stems that can be folded over to clamp to a material.

When an applique carries a self sticking (pressure-sensitive) adhesive for attachment to an apparel, the adhesive is covered by a release liner that is peeled away prior to attachment. Attaching an applique with pressure sensitive adhesive to a garment is almost always of a temporary nature. Pressure sensitive adhesives, no matter how thick or of permanent composition, will have a tendency to be peeled off a fabric surface such as a garment or they will start to lift of their own accord during use. Most pressure sensitive adhesives perform very poorly on surfaces such as water repellant nylon ( as used on back packs and tote bags).

The applique should be attachable to most types of apparel, whether these be made of nylon, polyester, or other synthetic material or cotton, wool or combinations thereof. Typically an applique affixed with a pressure sensitive adhesive to an apparel tends to have an edge lift off due to movements by the wearer or the curvature of the apparel Adhesives are attractive to the manufacturer because they are easy to include in a manufacturing process for the applique as well as render it easy for the end user to apply the applique to an apparel.

Appliques are frequently used for promotion purposes and it is, therefore, advantageous to include the applique with appropriate promotional material in a convenient and display effective manner. When the applique is to be attached with an adhesive, combining of the applique in a unique or special manner with the promotional material adds complexity.

SUMMARY OF THE INVENTION

It is, therefore, an object of the invention to provide an applique that is convenient to manufacture, releasably attachable to a carrier card and easy to remove from the carrier and to subsequently apply by an end user to suitable apparel, in a temporary or permanent manner, whether this be a T-shirt, sweater, hat, shorts, back pack, tote bag, umbrella or the like.

This is achieved in accordance with one embodiment of the invention by forming an applique having an adhesive layer on one side covered by a release liner and with an integrated mechanical fastener system. This fastener system enables the applique to be releasably attached to a carrier card and subsequently removed from the carrier. An end user may then attach the applique to an apparel by means of the adhesive and the mechanical fastener.

The integrated fastener can be of a conventional form as described above, but preferably is formed of a type which has a stem that can penetrate an apparel and be held to it by a removable cap or be bent over to clamp the apparel on its inner side. The fastener includes a generally flattened segment which is placed between inner and outer layers of the applique with a stem extending from the flat segment through the inner layer, the adhesive layer and the overlying release liner to extend outwardly from the applique.

The stem can be used to affix the applique to a carrier such as a promotion card. In such case the portion of the stem projecting from the applique is used to pierce the card from one side, either through the card material or through previously formed die cut holes. The cap is then applied to the end of the stem extending from the other side of the card to prevent release of the applique. The card can bear such promotional printing as is needed and is made available in that form to the end user.

In an alternate fastener the stem can be used to pierce the card and then is bent over to secure the applique to the card.

The end user removes the cap from the stem and the release liner from the applique. The applique is then applied to the apparel. The stem of the fastener will penetrate through the apparel, and the adhesive on the applique will be pressed up against the apparel to hold the applique somewhat to the apparel. The cap, or multiple caps if more than one stem is employed, is then snapped onto the protruding stem on the inside of the apparel, further securing the applique to the apparel. This enables the applique to be applied to many different materials and shapes while assuring a reliable and proper attachment.

A fastener can be used with which releasable attachment to an apparel can be made in a safe and reliable manner. This involves a male element having a flat segment and a specially shaped stem and a cap having a complementary shaped female receptacle. The stem has a piercing end and a laterally protruding edge that can move past a corresponding edge in the receptacle. In this manner the stem can be releasably captured inside the receptacle while the end of the stem is either covered by or recessed within the cap. By utilizing a releasable fastener, and knowing that pressure sensitive adhesives do not hold on clothing with a high degree of permanence, the applique can be easily removed from a garment and re-attached to another surface. Should the end user required an applique as a permanent attachment, then a permanent stem and cap fastener can be used.

It is, therefore, another object of the invention to provide an applique that is convenient to manufacture, ship to end users and then attach to an apparel in a secure manner.

These and other advantages and objects of the invention can be understood from the following description of several embodiments as shown in the drawings.

DETAILED DESCRIPTION OF DRAWINGS

Figure 1:
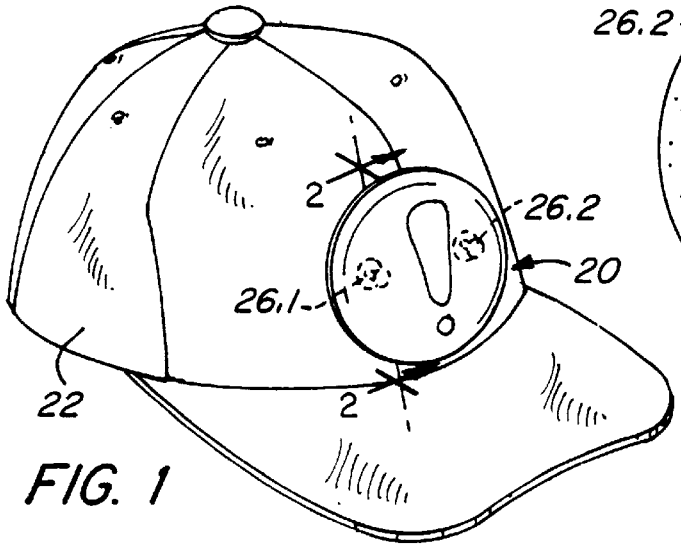
FIG. 1 is a perspective view of a hat onto which an applique in accordance with the invention is attached.
Figure 4:
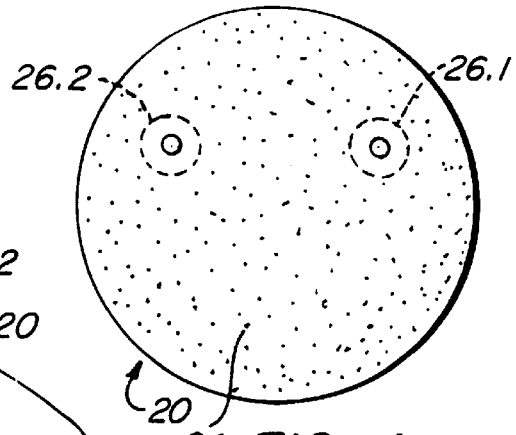
FIG. 4 is a bottom view of the applique of FIG. 1.

With reference to FIGS. 1–7, an applique 20 in accordance with the invention is shown mounted on an apparel such as a hat 22. The applique 20 is mounted to hat 22 by way of an adhesive 24 shown at 24 on the back of the applique 20 in FIG. 4 and a pair of pressure engaging fasteners 26.1 and 26.2. The applique typically is formed of a multi-layered vinyl structure though other materials than vinyl can be used.

The invention is illustrated herein for use with an apparel such as a hat 22. It should be understood, however, that an applique in accordance with the invention can be used on other materials and articles such as garments, accessories, nylon materials, water proof materials and the like. The term apparel as used in the specification and claims, therefore, includes these other various materials and articles.

The applique has a top or outer vinyl layer 28, a bottom or inner layer 30 and thesis are typically sealed together with other materials such a foam layer 32 placed between layers 28 and 30. The formation of a multi-layered vinyl structure is well known in the art, see for example the U.S. Pat. No. 3,758,358 to Kuroda.

Figure 2:
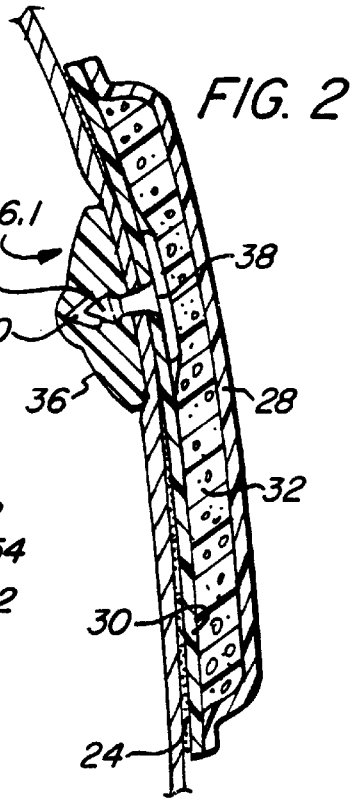
FIG. 2 is a section view taken along the line 2—2 in FIG. 1.
Figure 6:
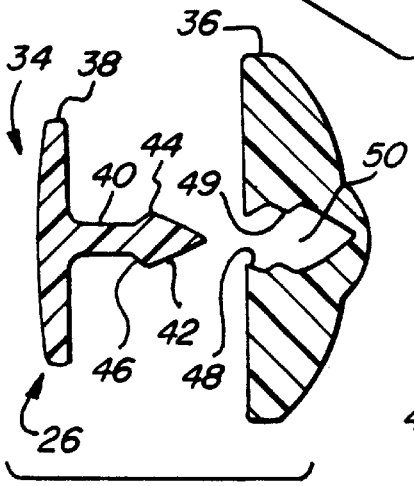
FIG. 6 is a section view of a fastener of FIG. 5.

The fasteners 26 are preferably formed of plastic with a male part 34 and a female segment 36. The male part 34 has a generally flat head or segment 38 and is embedded inside the applique as shown in FIG. 2. The male part 34 has a projecting stem 40 with a pointed end 42 so as to be able to penetrate the inner vinyl layer 30 of the applique 20 and a release liner as will be explained. The stem end 42 further has an enlarged annular edge 44 and an annular, sloped, back edge 46 used to seat against either a first rim 48 or a second rim 49 inside a capturing recess 50 in the female segment 36.

Different fasteners can be employed such a metal bendable fastener having a flat segment with end located flat stems that can penetrate an apparel and subsequently be bent over to affix to the apparel. The term stem, therefore, includes these various fastener elements used to penetrate an apparel.

Figure 7:
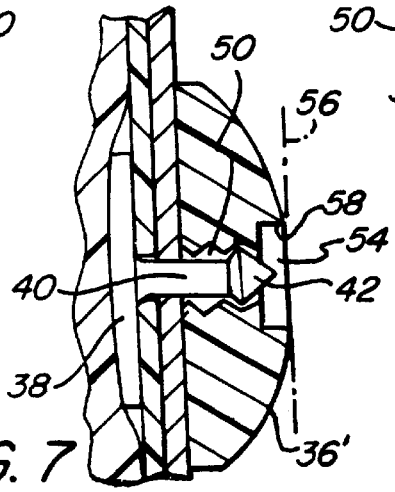
FIG. 7 is a partial section view of another fastener in accordance with the invention as applied to an applique as shown in FIG. 1.
Figure 10:
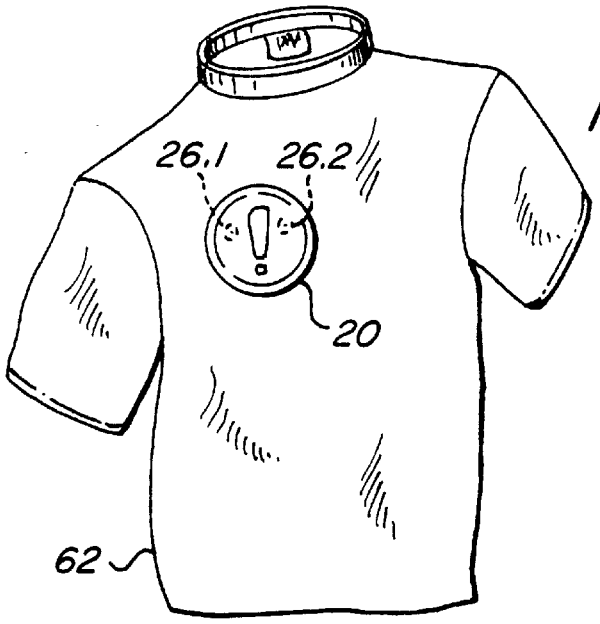
FIG. 10 is a perspective view of an applique in accordance with the invention as mounted on a T-shirt.

The female segment 36 can be applied and removed because the back edge 46 slopes down to a smaller cross-sectional dimension from that of annular edge 44 and the diameters of the annular rims 48, 49 inside recess 50 are selected to enable this. Variations can be made from the described fastener 26 as illustrated in the view of FIG. 7 wherein the male part 34 is the same but a female segment 36' is formed having a through bore 52 that has a recess portion 50. A counter bore 54 is formed on the other side of the recess 50 so as to receive the stem end 42 without projecting past a projected plane 56 defined by the end of side 58 of the counter bore 54.

Figure 3:
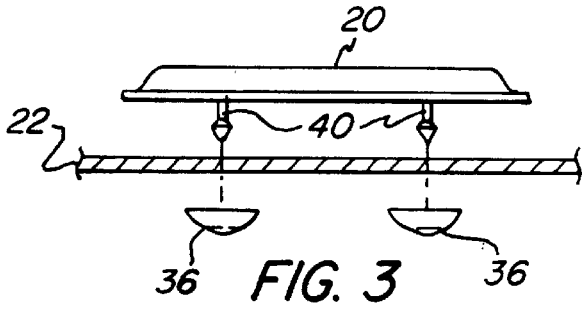
FIG. 3 is an exploded side view of an applique in accordance with the invention and its associated fasteners.
Figure 5:
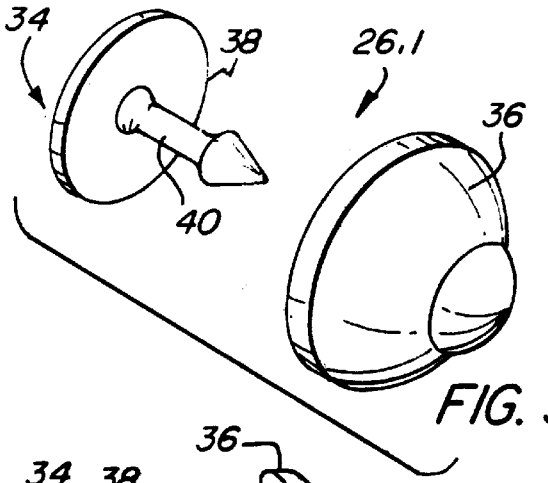
FIG. 5 is an exploded perspective view of one fastener in accordance with the invention for use with an applique.

The applique is affixed to hat 22 with the use of the adhesive layer 24 and the fasteners 26.1 and 26.2 whose female segments 36 or 36' encapsulate the stem ends 42 after the stems 40 have penetrated the hat fabric as illustrated in the view of FIG. 3. The adhesive 24 with the use of the engaging pressure from the fasteners 26 assures a reliable attachment of the applique 20 to the hat 22. When attachment to a thin apparel is to be made the stem 40 can be sufficiently extended into recess 50 to seat its back surface 46 against inner rim 49 while firmly gripping the apparel. When a thicker apparel material is encountered the stem back surface can be seated against the first rim 48.

Figure 8:
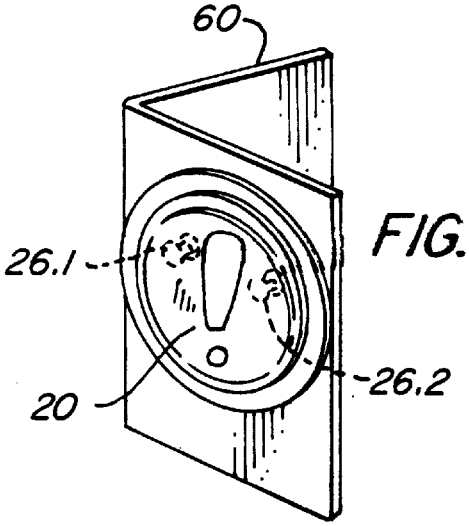
FIG. 8 is a perspective view of an applique in accordance with the invention as mounted on a carrier card.
Figure 9:
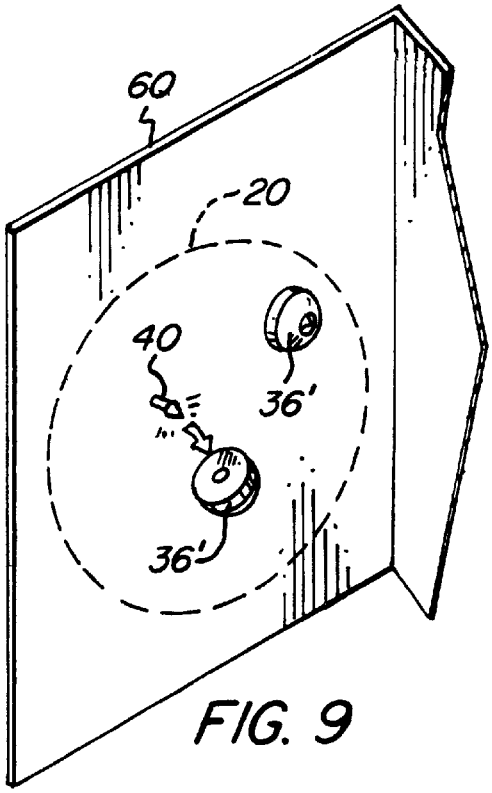
FIG. 9 is a rear perspective enlarged view of the carrier card as shown in FIG. 8.
Figure 14:
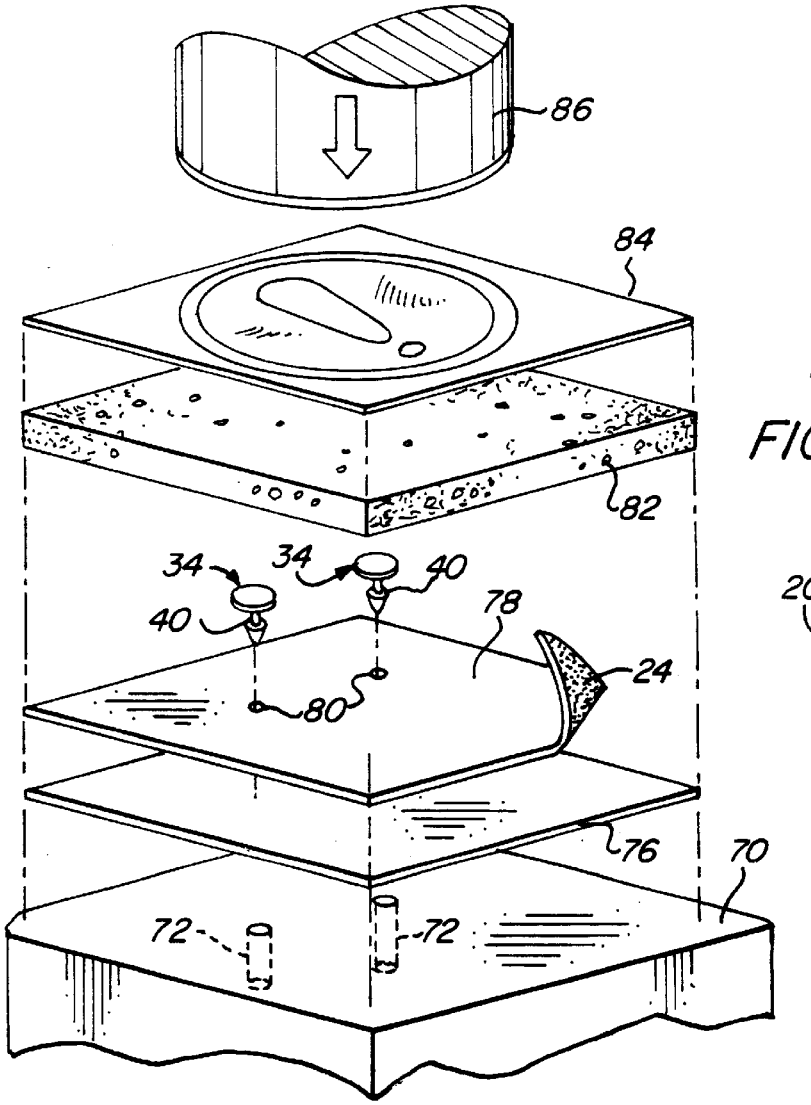
FIG. 14 is a perspective exploded view of one technique in accordance with the invention for making an applique as shown in FIG. 1.

Of particular advantage in the use of an applique in accordance with the invention is that the fasteners 26 can be employed to mount the applique 20, whose adhesive layer 24 is covered by a suitable release liner, to a carrier such as a card 60 or the like as shown in FIGS. 8 and 9. The carrier 60 can bear advertising or other promotional information. With the ability to separate the applique 20 from the card 60 by removing the female segments 36 an attractive marketing tool is provided to deliver the applique 20 to an end user who can affix it to an apparel such as T-shirt 62.

Figure 11:
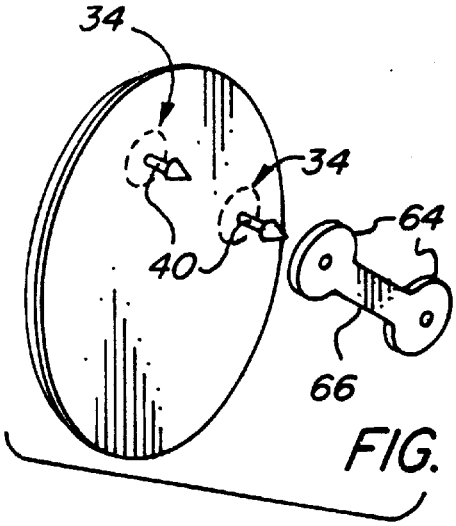
FIG. 11 is a perspective view of an alternate form for a fastener in accordance with the invention for use in an applique.
Figure 12:
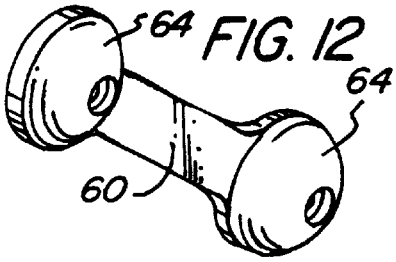
FIG. 12 is a perspective view of female parts of the fastener in FIG. 11.
Figure 13:
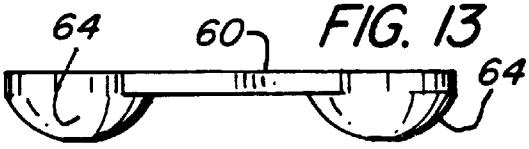
FIG. 13 is a side view of the female fastener part shown in FIG. 12.

Although multiple fasteners 26 are shown to mount the applique 20 to an apparel, a single fastener 26 can be employed. Conventional fasteners can be used in which a male part engages a female segment in a releasable fashion. Other fasteners can be employed. One fastener can have a flat segment with one or several bendable stems. After a stem has penetrated the card or apparel the stem can be bent over to firmly affix the applique. For example in FIGS. 11–13 a pair of male parts 34 are used but the complementary fitting female segments 64, similar to segments 36', are joined or molded as one piece by a cross member 66. This facilitates the time and effort needed to affix an applique to a carrier card 60 and strengthens attachment to an apparel. Permanent fasteners can also be used in the event that the user requires an applique that is permanently affixed to an apparel.

With reference to FIGS. 14–17 a method for making and using the applique 20 is shown. A single applique 20 is illustrated, though it is to be understood that in practice an array of them can be assembled and the described steps are illustrative of the invention. A support or anvil surface 70 has a pair of recesses 72 sized to receive the stems 40 of male parts 34 of the fasteners 26. A release sheet 76 is placed over the surface 70, covering the recesses 72. An inner vinyl sheet 78, bearing an adhesive layer 24, is placed over the release sheet 76 with the adhesive facing the release sheet 76.

Male parts 34 are applied to previously marked areas or holes 80 in the vinyl sheet 78 so that the stems 40 can penetrate both the sheet 78 and the release liner 76 at the places where the stems 40 can enter the recesses 72. An optional foam sheet 82 is then placed over the male parts 34 and a top vinyl sheet 84 is applied over the foam sheet 82. This traps the heads 38 of the male parts 34 between the inner and outer sheets 76, 84. The outer sheet typically is provided with an appropriate decorative printing as illustrated.

Figure 16:
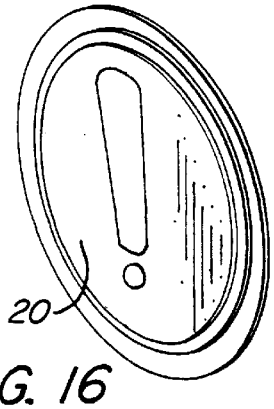
FIG. 16 is a perspective view of an applique made in accordance with the technique as shown in FIG. 14.

A previously formed RF cutting and sealing die 86 is then applied. The die 86 has recesses and projections so as to form depressions and raised areas in the vinyl applique in a manner as is well known in the art. The RF die 86 forms the final shape of the applique as illustrated in FIG. 16 while trapping the male parts 34 in accordance with the invention. The applique can then be applied to a carrier 60 as shown in FIGS. 8 and 9 or be shipped directly to customers with the female segments 35 either attached or loose.

If desired, the attachment of the applique to the carrier 60 can be done during the formation of the applique by placing the carrier 60 first onto the support surface 70 before the release sheet 76 is applied. In such manner the carrier can, in a single step of the die, be applied to the applique. The recesses 72 in the anvil surface 70 can be made sufficiently large to accommodate the female segments 36 so that the applique 20 can be affixed to the carrier 60 at same time that the applique is formed with the die 86.

Figure 17:
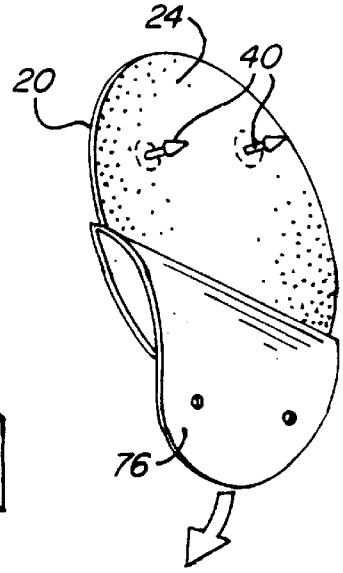
FIG. 17 is a perspective view of the applique as it is applied by an end user.
Figure 15:
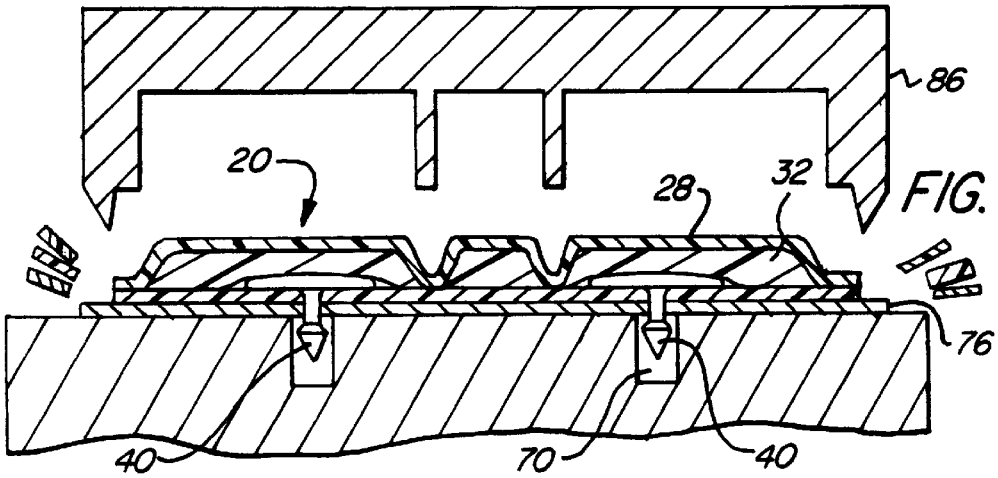
FIG. 15 is a section view of a die cutting operation in the method of FIG. 14.

When the end user desires to apply the applique 20 to an apparel, the female segments 36 are first removed from the male parts 34 and the applique separated from its carrier 60. The release liner 76 is then removed as shown in FIG. 17 to expose the adhesive 24 and the applique is attached by penetrating an apparel with the stems 40 either with a first click for a thicker apparel or a double click for a thin apparel. The female segments 36 are then re-applied to firmly affix the applique 20 to the apparel with the action of the adhesive layer 24 and the fasteners 26.

Figure 18:
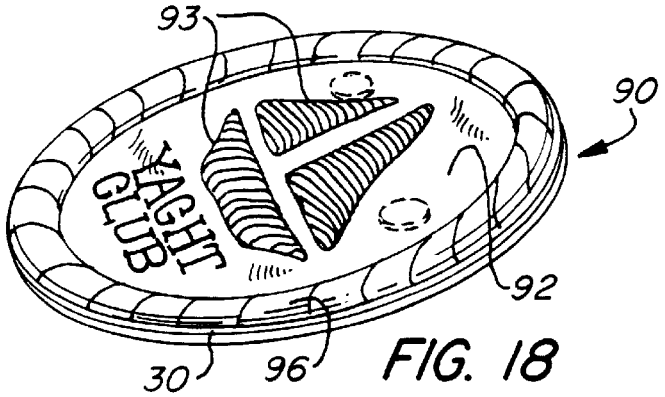
FIG. 18 is a perspective view of an embroidery type applique having a mechanical fastener and adhesive attachment feature in accordance with the invention.
Figure 19:
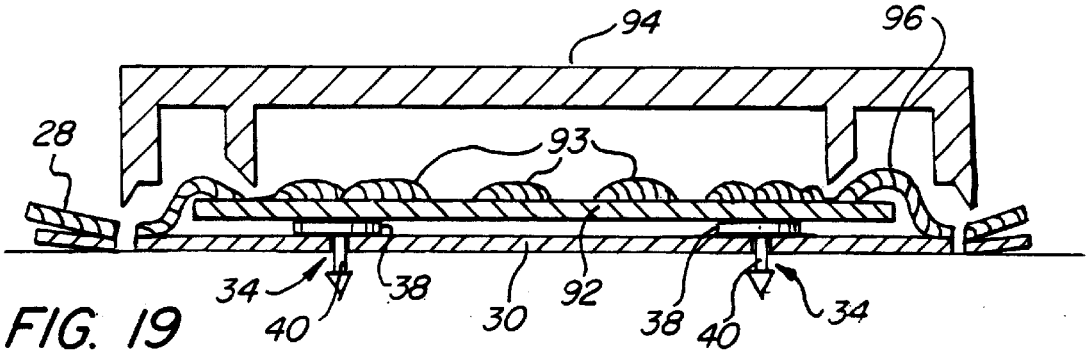
FIG. 19 is a sectional view of a die during the manufacture of an embroidery type applique as shown in FIG. 18.
Figure 20:
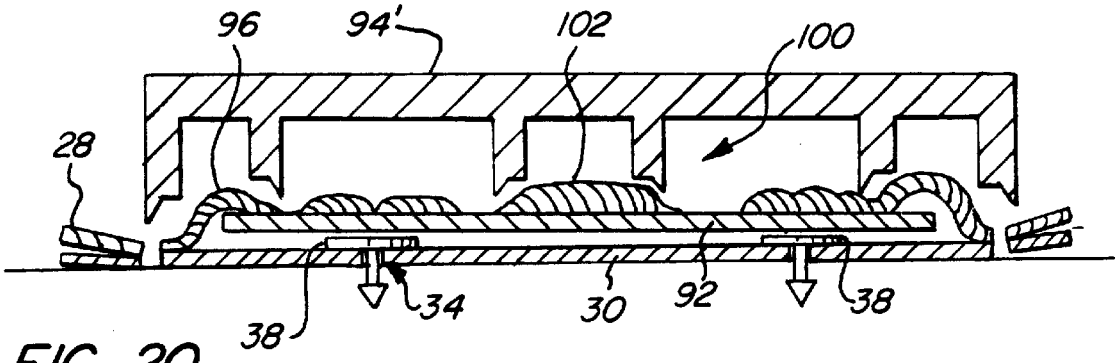
FIG. 20 is a cross-sectional view of another die for the manufacture of a different embroidery type applique in accordance with the invention.

With reference to FIGS. 18–20 an embroidery type multi-layered applique 90 is shown encapsulating the flat portions 38 of mechanical fasteners 34. To create a fabric/embroidery applique 90, a fabric material 92 such a twill fabric is placed in an embroidery machine, not shown. The pattern 93 can be embroidered individually to the fabric or multiples, for example when small emblems are required. The embroidered patterns are taken and die cut into a final desired shape, which can be oval, a circle, square or other. A backing vinyl sheet such as 30, having an adhesive layer 24 and an overlying release liner 76 is provided with plastic or metal fastener parts 34 with stems 40 protruding. An RF sealing die 94 is made and so designed as to seal an upper or outer vinyl sheet 28 at least along a perimeter to form a vinyl perimeter border 96 in the manner as shown in FIG. 19 while simultaneously sealing the top vinyl border 96 to the backing vinyl sheet 30.

Any unattached vinyl cut away from the upper vinyl sheet 28 and located within the border 96 is then stripped away. This will result in a combination applique 90 as shown in FIGS. 18 and 19 having a vinyl surrounding perimeter 96 that adheres to both the in broidery layer 92 and the underlying backing vinyl sheet 30 and surrounds an embroidered pattern 93.

FIG. 20 illustrates an embroidery applique 100 having decorative portions, such as 102 of the upper vinyl sheet 28 sealed to portions of the fabric 92 within the perimeter border 96. Hence; when the excess outer vinyl sheet 28 is stripped away from within the border 961 vinyl decorations 102 can be interspersed with the embroidery pattern. The fabric 92 may, prior to being formed into an applique be further decorated using other techniques such as screen printing, embossing, addition of flock material or other embellishments. The embroidered patch can be directly affixed to a backing vinyl sheet by sewing or by preparing its back surface so as to be able to be affixed to a backing vinyl sheet 30.

Having thus described several embodiments of the invention its advantage can be appreciated. Variations from the embodiments can be implemented by one skilled in the art For example, the embodiments are described in conjunction with the use of vinyl materials whose RF welding is well known. However, the combination of an entrapped mechanical fastener part between a multi-layered structure together with an adhesive could involve material other than vinyl. This, for example, can be a reflector or PVC molded applique, a felt emblem, a leather patch, an embroidered emblem, a fabric patch and other embellishments and decorative emblems.

What is claimed is:

1. An article for attachment to an apparel, comprising:

an applique having an outer layer bearing a decorative design and an inner layer bearing an adhesive layer for attachment to an apparel;

at least one fastener having a generally flat segment at one end and a stem at an another opposite end, the stem having an enlarged edge provided with a first surface, which has a substantially conical cross-section pointing away from the flat segment, and a sloped back edge between the flat segment and the enlarged edge portion and having a second surface with a substantially frustoconical cross-section, which narrows toward the flat segment; said generally flat segment being disposed between the inner and outer layers with the stem extending through said inner layer and said adhesive to protrude through said inner layer; and a cap having at least one recess provided with first and second inner surfaces which extend complementary to the first and second surfaces of the fastener, respectively, to enable the cap to releasably engage the fastener.

2. The article for attachment of an apparel as claimed in claim 1 wherein said cap has another recess adjacent to the one recess and shapes substantially similar to the one recess, said fastener being displaceable between a first position, wherein the fastener is received in the one recess, and a second position, wherein said fastener is received in the another recess upon application of an external force.

3. The article for attachment to an apparel as claimed in claim 1 wherein said cap recess terminates inside the cap.

4. The article for attachment to an apparel as claimed in claim 1 wherein said cap recess extends through said cap.

5. An article for attachment to an apparel, comprising:

an applique having an outer layer bearing a decorative design and an inner layer bearing an adhesive layer for attachment to an apparel;

at least one fastener having a generally flat segment at one end and a stem at another opposite end, the stem having an enlarged edge provided with a first surface which has a substantially conical cross-section pointing away from the flat segment, and a sloped back edge between the stem and the enlarged edge and having a second surface with a substantially frustoconical cross-section, which narrows toward the flat segment; said generally flat segment being disposed between the inner and outer layers with the stem extending through said inner layer and said adhesive;

a release liner overlying said adhesive layer with said stem extending through said release liner;

a carrier card; said stem extending through said carrier card; and a cap having a recess sized to receive and releasably capture said stem and provided with an inner surface having a first segment, which extends complementary to the first conical surface of the enlarged edge, and a second segment, which extends complementary to at least part of the second frustoconical surface of the sloped back edge of the fastener and releasably engaging them upon affixing the applique to said carrier card.

6. An article for attachment to an apparel, comprising:

an applique having an outer layer bearing a decorative design and an inner layer bearing an adhesive layer for attachment to an apparel;

at least one fastener having generally a generally flat segment at one end and a stem at another opposite end, the stem having an enlarged edge provided with a first surface, which points away from the flat segment, and a sloped back edge adjacent to the enlarged edge portion and having a second surface, which narrows toward the flat segment; said generally flat segment being disposed between the inner and outer layers with the stem extending through said inner layer and said adhesive layer;

a release liner overlying said adhesive layer with said stem extending through said release liner;

a carrier card; said stem extending through said carrier card to affix the appliqué to said carrier card; and a cap having a recess provided with an inner surface having a first segment, which extends complementary to the first surface, and a second segment, which extends complementary to at least part of the second surface of the enlarged and sloped back edges of the fastener, respectively, and releasably engaging them so as to capture the stem and retain the applique to said carrier card during shipment to a user of the applique and to said apparel with said adhesive layer after said release line has been removed by an end user.

7. An embroidered article for attachment to an apparel, comprising:

a fabric layer having an embroidery pattern on an outer surface;

a backing vinyl layer located below the fabric layer and attached thereto, said backing layer having an adhesive layer for attachment to an apparel;

a vinyl border affixed to the fabric layer and said backing layer;

at least one fastener having generally a generally flat segment at one end and a stem at another opposite end, the stem having an enlarged edge provided with a first surface, which points away from the flat segment, and a sloped back edge between the flat segment and the enlarged edge portion and having a second surface which narrows toward the flat segment; said generally flat segment being disposed between the fabric layer and said backing layer with the stem extending through said backing layer and said adhesive layer to protrude from said backing layer;

a cap having a recess provided with an inner surface having a first segment which extends complementary to the first surface, and a second segment, which extends complementary to at least part of the second surface of the enlarged and sloped back edges of the fastener, respectively, so as to releasably capture the stem and retain the embroidered article to said apparel.

8. The embroidered article as claimed in claim 7 and further including a decorative vinyl pattern segment placed on and heat sealed to the outer surface of said fabric layer.

* * * * *